US009402448B2

(12) United States Patent
Takehara et al.

(10) Patent No.: US 9,402,448 B2
(45) Date of Patent: Aug. 2, 2016

(54) SURFACE FASTENER WITH EXCELLENT TEMPORARY FIXING FUNCTION

(75) Inventors: Keiji Takehara, Hyogo (JP); Satoru Ono, Fukui (JP)

(73) Assignee: KURARAY FASTENING CO., LTD., Osaka-shi (JP)

( * ) Notice: Subject to any disclaimer, the term of this patent is extended or adjusted under 35 U.S.C. 154(b) by 343 days.

(21) Appl. No.: 13/812,369

(22) PCT Filed: Jul. 11, 2011

(86) PCT No.: PCT/JP2011/065816

§ 371 (c)(1),
(2), (4) Date: Jan. 25, 2013

(87) PCT Pub. No.: WO2012/014667

PCT Pub. Date: Feb. 2, 2012

(65) Prior Publication Data

US 2013/0133176 A1 May 30, 2013

(30) Foreign Application Priority Data

Jul. 27, 2010 (JP) ..... 2010-167938

(51) Int. Cl.
*A44B 18/00* (2006.01)

(52) U.S. Cl.
CPC ..... *A44B 18/0015* (2013.01); *A44B 18/0065* (2013.01); *Y10T 24/27* (2015.01); *Y10T 24/2767* (2015.01); *Y10T 29/4995* (2015.01); *Y10T 29/49952* (2015.01)

(58) Field of Classification Search
CPC ..... A44B 18/0015; A44B 18/0019; A44B 18/0038; A44B 18/0046; A44B 18/0049; A44B 18/0061; B29C 43/222; B29C 67/08; Y10T 29/4995; Y10T 29/49952; Y10T 24/27
See application file for complete search history.

(56) References Cited

U.S. PATENT DOCUMENTS 4,894,060 A 1/1990 Nestegard
6,642,160 B1 11/2003 Takahashi
(Continued)

FOREIGN PATENT DOCUMENTS

CN 1196908 A 10/1998
CN 1617682 A 5/2005
(Continued)

OTHER PUBLICATIONS

English Machine Translation of JP H05199911 (A).*
(Continued)

*Primary Examiner* — Sarang Afzali
(74) *Attorney, Agent, or Firm* — Oblon, McClelland, Maier & Neustadt, L.L.P

(57) ABSTRACT

A molded surface fastener, including: a large number of male fastening elements projecting upward from the surface of a plastic plate, each of the male fastening elements having a stem projecting upward from the plastic plate and an engaging projection projecting sideways from the stem, where each of the male fastening elements has a height (H) of 1.5-3.0 mm, a length (D) from the uppermost tip to the lower end of the engaging projection of 0.675-2.25 mm, and a ratio length (D) to the height (H), (D)/(H), of 0.45-0.75, where the plate coverage of male fastening elements is 25-45%, and where each of the male fastening elements has an anti-sticking projection projecting away from the plate above the engaging projection.

11 Claims, 4 Drawing Sheets

(56) References Cited

U.S. PATENT DOCUMENTS

| | | | | |
|---|---|---|---|---|
| 6,687,962 | B2 * | 2/2004 | Clarner | A44B 18/0053 24/442 |
| 7,067,185 | B2 * | 6/2006 | Ausen et al. | 428/100 |
| 7,185,401 | B2 * | 3/2007 | Ausen et al. | 24/451 |
| 7,235,202 | B2 * | 6/2007 | Seth et al. | 264/145 |
| 2003/0131453 | A1 * | 7/2003 | Clarner | A44B 18/0053 24/452 |
| 2003/0145440 | A1 | 8/2003 | Ausen et al. | |
| 2008/0229556 | A1 | 9/2008 | Hammer | |

FOREIGN PATENT DOCUMENTS

| | | |
|---|---|---|
| JP | 52 37414 | 9/1977 |
| JP | 2 5947 | 1/1990 |
| JP | 5 199911 | 8/1993 |
| JP | 6 34503 | 5/1994 |
| JP | 6-34503 | 5/1994 |
| JP | 6 133808 | 5/1994 |
| JP | 10 304909 | 11/1998 |
| JP | 11-155612 A | 6/1999 |
| JP | 2003 125813 | 5/2003 |
| JP | 2005 514976 | 5/2005 |
| JP | 2007/530114 | 11/2007 |

OTHER PUBLICATIONS

English Machine Translation of JP H06133808 (A).*

English Machien Translation of JP H0634503 (U).*

International Search Report Issued Aug. 16, 2011 in PCT/JP11/65816 Filed Jul. 11, 2011.

Combined Chinese Office Action and Search Report issued May 28, 2015 in Patent Application No. 201180036540.X (with English Translation of Category of Cited Documents).

Office Action issued Oct. 6, 2015, in Japanese Patent Application No. 2012-526408.

Office Action issued May 24, 2016, in Japanese Patent Application No. 2012-526408.

* cited by examiner

SURFACE FASTENER WITH EXCELLENT TEMPORARY FIXING FUNCTION

TECHNICAL FIELD

The present invention relates to a surface fastener with excellent temporary fixing function. Specifically, the present invention relates to a male surface fastener being hardly causing an engagement when the fastener surface of the male surface fastener is overlaid on that of a female surface faster by small force but generating strong engagement force only when the fastener surface of the male surface fastener is overlaid on that of the female surface faster by large force. The present invention also relates to a combination of the male surface fastener and a suitable female surface fastener.

BACKGROUND ART

Conventionally, as one of the means for attaching an intended object to the surface of an object, a method of fastening an intended object to the surface of the object is used, including fixing a male surface fastener with hook-shaped fastening elements to the surface of the object or the intended object, fixing a female surface fastener with loop-shaped fastening elements to the surface of the other object, and overlaying the both the surface fasteners on each other to engage the hook-shaped fastening elements with the loop-shaped fastening elements.

A male surface fastener falls roughly into two types: a woven male surface fastener provided with a large number of hook- or mushroom-shaped fastening elements formed from mono-filaments, in which the fastening elements project upword from the surface of a base fabric formed from knitted woven fabric; and a molded male surface fastener provided with a large number of stems formed from plastic, in which the stems project upword from a plastic plate and in which the tip of each of the stems is mushroom- or hook-shaped. The present invention relates to this molded male surface fastener.

As a representative example of such a molded male surface fastener, the surface fastener described in Patent document 1 or a surface fastener with fastening elements being proportionally expanded from those of the surface fastener described in Patent document 1 is known.

When such a surface fastener is attached on the surface, one surface fastener is first fixed to the surface of an object, and the other surface fastener is then fixed to the surface of an intended object. However, before surface fasteners are fastened, the intended object to which a surface fastener has been fixed (or temporarily fastened) is brought close to the surface fastener of the object in the name of temporary fixing or positioning in order to check whether or not an intended object is accurately attached to a predetermined position.

However, in the case of a conventional surface fastener, particularly in the case of a surface fastener with fastening elements being proportionally expanded from those of the surface fastener described in Patent document 1, an unnecessary engagement is caused just by bring both the surface fasteners into contact with each other so that accurate positioning may not be achieved. When caused, such an unnecessary engagement between the surface fasteners needs to be removed to repeat the positioning. On the other hand, if bringing both the surface fasteners close to each other for the positioning of the surface fasteners is omitted in order to avoid the unnecessary engagement being caused and then if the surface fasteners are directly and strongly attached to an appropriate part of the surface of an object and an intended object, respectively, which is so-called permanent engagement, the mispositioning between both the surface fasteners or the mispositioning from a predetermined attachment position of the intended object may be caused. This leads to a difference between the attachment position of the intended object and a predetermined position, resulting in a failure. In this case, when the engagement is released to correct the failure, an intended object might be impaired.

In addition, particularly when the intended object is large, for example, the ceiling material and the wall material of a house, the automotive headliner and the wall member in the luggage room of an automobile, or the like, releasing an unnecessary engagement and repeating the positioning require tremendous time and effort. Furthermore, in a production line running at a constant rate, when a ceiling material and the like have to be attached within a limited time, the production line may be stopped for the release and the positioning. Therefore, it is very important that the positioning need to be conducted promptly and accurately.

To solve such a problem, a strong engagement should be prevented as much as possible from being caused only by overlaying both the surface fasteners on each other in positioning. For this purpose, a method of allowing hook-shaped fastening elements to hardly engage with loop-shaped fastening elements is considered, for example, in which the element densities of the hook-shaped fastening elements and the loop-shaped fastening elements are lowered, in which the shape of the (mushroom cap- or hook-shaped) heads of the hook-shaped fastening elements are downsized, or the like. Using such a method can actually decrease the occurrence of engagement in positioning. However, the engagement force is too low to provide a desired engagement force even after permanent engagement.

In a surface fastener in which loop-shaped fastening elements and hook-shaped fastening elements coexist on the same surface, which is a so-called hook-and-loop coexisting woven surface fastener, Patent document 2 discloses the structure with a reduced engagement being caused in temporary fixing and a strong engagement force being generated after permanent engagement. The technology described in this patent document improves a hook-and-loop coexisting woven surface fastener but cannot be applied to a molded male surface fastener.

Patent document 3 proposes that a molded surface fastener, in which a large number of fastening elements consisting of a stem and an expanded head located on the tip of the stem which projects upword from at least one surface, is provided with a large number of rows of minute projections and depressions and/or a differently leveled rows on the surface of the base material of the molded surface fastener and the surface of the expanded head or the stem of each fastening element so as to improve the gloss of the surface of the surface fastener.

However Patent document 3 does not describe the structure of a molded surface fastener reducing the engagement in temporary fixing and generating a strong engagement force even after permanent engagement.

Patent document 4 proposes a single hook fastener made of an elastic and flexible polymer resin, including a base film layer having an upper principal surface and a lower principal surface in approximately parallel, in which at least 50 spaced hook members per square centimeter project from the upper principal surface of the base, each of the hook members has a height of less than 1000 μm from the upper principal surface and includes a stem added at one end of the base and a head at the end of the stem that is opposed to the base side, and at least the head has a thickness of 50-200 μm in a first direction approximately parallel to the surface of the backing.

However, Patent document 4 does not describe the structure of a molded surface fastener reducing the engagement in temporary fixing and generating a strong engagement force even after permanent engagement.

Patent Document 1: JP 2-5947 A
Patent Document 2: JP 2003-125813 A
Patent Document 3: JP 6-34503 (U)
Patent Document 4: JP 2005-514976 A

DISCLOSURE OF THE INVENTION

An objective of the present invention is to improve a surface fastener, particularly, a molded male surface fastener, the only overlaying of which causes an engagement to make the positioning extremely difficult and to provide a molded male surface fastener obtaining a strong engagement force after permanent engagement without causing a strong engagement in temporary fixing (i.e. positioning), a female surface fastener used in a pair with this molded male surface fastener, and a method of fastening these surface fasteners.

As a result of study with great effort, it is found that the problem is solved by using a surface fastener including a large number of male fastening elements which project upword from the surface of a plastic plate, in which the ratio (D/H) of the length (D) from the uppermost tip of each of the fastening elements to the lower end of the engaging projection of the fastening element to the height (H) of the fastening element from the plate is 0.35-0.75, and the plate coverage of fastening elements is 25-45%, and then the present invention has been achieved.

Specifically, the present invention provides:

[1] a molded surface fastener including a large number of male fastening elements which project upword from the surface of a plastic plate, in which each of the male fastening elements has a stem projecting upword from the plastic plate and an engaging projection projecting sideways from the stem, the ratio (D/H) of the length (D) from the uppermost tip of each of the fastening elements to the lower end of the engaging projection of the fastening element to the height (H) of the fastening element from the plate is 0.35-0.75, and the plate coverage of fastening elements is 25-45%;

[2] the molded surface fastener according to [1], in which the fastening element has an anti-sticking projection projecting away from the plate above the engaging projection;

[3] the molded surface fastener according to [2], in which the ratio (D/H) is 0.45-0.65;

[4] the molded surface fastener according to [1], in which the thickness (W) of the fastening element is 0.15-0.6 times the height (H) of the fastening element;

[5] a female surface fastener used in a pair with the surface fastener according to [1], including a loop formed from multi-filament yarn on the surface of the plate;

[6] a female surface fastener used in a pair with the molded surface fastener according to [1], including a loop formed from multi-filament yarn on the surface of the plate, in which the multi-filament yarn forming the loop is fixed up with a resin;

[7] a female surface fastener used in a pair with the molded surface fastener according to [1], including a loop formed from mono-filament yarn on the surface of the plate;

[8] a method of fastening a ceiling material to a ceiling base material, comprising: fixing the molded surface fastener according to [1] to any one of the base material and the ceiling material, attaching a surface fastener engageable with the molded surface fastener to the other material, and engaging both the surface fasteners with each other; and

[9] a method of fastening a decorative board to a wall base material, comprising: fixing the molded surface fastener according to [1] to any one of the base material and the decorative board, attaching a surface fastener engageable with the molded surface fastener to the other material, and engaging both the surface fasteners with each other.

REFERENCE SIGNS LIST

B . . . Plate
E . . . Male fastening element
S . . . Stem
T . . . Engaging projection
M . . . Anti-sticking projection
H . . . Height of fastening element from plate
D . . . Length from the uppermost tip of fastening element to the lower end of engaging projection of the fastening element
W . . . Thickness of male fastening element
V . . . Length of engaging projection
Y . . . Row direction of fastening elements
X . . . Cut direction of fastening elements

THE MOST PREFERRED EMBODIMENT TO CARRY OUT THE INVENTION

Figure 1:
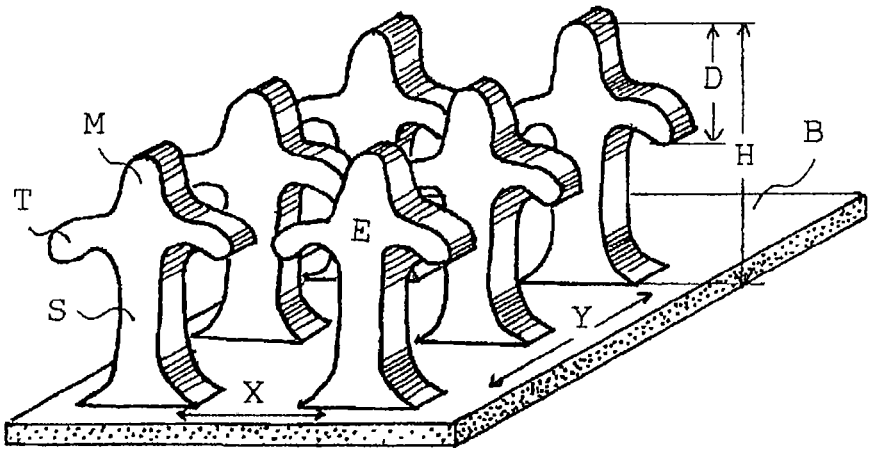
FIG. 1 shows the partially perspective view of a preferred example of the molded male surface fastener of the present invention.
Figure 2:
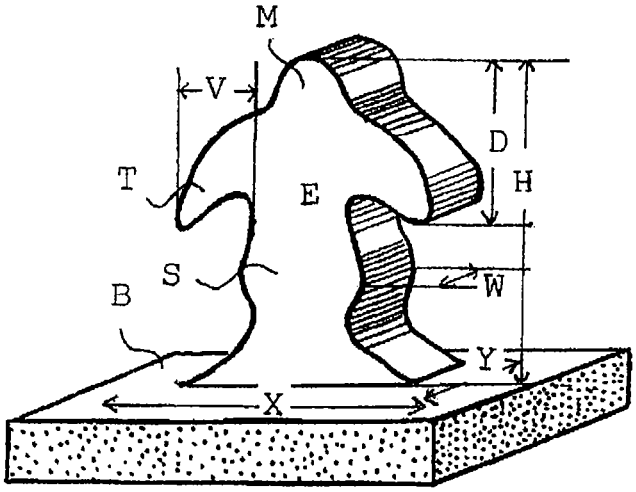
FIG. 2 shows the perspective view of a preferred example fastening element forming the molded male surface fastener of the present invention.

The preferred embodiment of the present invention will be explained below in reference to FIGS. 1-8. A preferred example of the molded male surface fastener of the present invention includes a molded male surface fastener as shown in FIG. 1, and fastening elements forming the male surface fastener includes a fastening element as shown in FIG. 2. In these figures, B represents the plate of the surface fastener, and E represents a male fastening element. The male fastening element (E) projects upword from the plate (B). The male fastening element (E) has a stem (S) projecting upword from the plate and an engaging projection (T) projecting sideways from the upper part of the stem. The male fastening element (E) shown in FIGS. 1 and 2 has an anti-sticking projection (M) at the tip of the stem.

In the male fastening element (E), the engaging projection (T), the part of the stem above the base of this projection, and the above-mentioned anti-sticking projection are sometimes called the head of the fastening element. In other words, the male fastening element consists of a stem without any engaging projections on its sides and a head existing at the upper part of this stem.

Typically, in the molded male surface fastener of the present invention, such a plurality of fastening elements line up at regular intervals in the longitudinal direction (represented by Y as shown in FIGS. 1 and 2), in other words, in the direction of the surface without any engaging projections. The fastening elements also line up in parallel to the traverse direction (represented by X shown in FIGS. 1 and 2).

The plate (B) and the male fastening element (E) are made of plastic. The plate (B) and the male fastening element (E) may be made of different resins respectively but typically the same resins from the viewpoint of productivity.

The resin to be used is not limited in particular, including resins to be used for typical molding, for example, polyolefin resins such as polyethylene and polypropylene; nylon resins such as nylon 6 and nylon 66; polyester resins such as polyethylene terephthalate, polybutylene terephthalate and polylactic acid; polyvinyl chloride resins; styrene resins; and acrylic resins. The resin to be used may also be a polyester elastomer resin, a polyolefin elastomer resin, a polystyrene elastomer resin, or a polyurethane elastomer resin, or may be a copolymer of these resins. Furthermore, the resin may be used alone or in combination of two or more.

Among these, a resin with fiber-forming and stretching properties is preferable, specifically including polyolefins such as polyethylene and polypropylene, nylons, and polyesters. In the molded male surface fastener of the present invention, since the head of the male fastening element hardly leans, hardly leading the engagement with the loop-shaped fastening element to be released, the loop-shaped fastening element tends to be easily cut when forced to be removed. To prevent this, the molded male surface fastener is preferably molded of an elastomer resin.

As described below, the fastening element of the present invention has a ratio (D/H) of the length (D) from the uppermost tip of the fastening element (E) to the lower end of the engaging projection (T) to the height (H) of the fastening element of 0.35-0.75, which is extremely high, compared with a conventional one. This is one of the main features of the molded male surface fastener of the present invention.

The male fastening element (E) has a stem (S) and an engaging projection (T) projecting sideways from the stem. Preferably, the engaging projection (T) typically and symmetrically projects both sideways from the stem. The stem (S) is typically projecting upword from the plate (B). In order to enhance the engagement force, the engaging projection (T) projects in parallel to the plate or in the direction where the tip hangs down toward the plate side rather than in parallel to the plate as shown in FIGS. 1-4.

Figure 5:
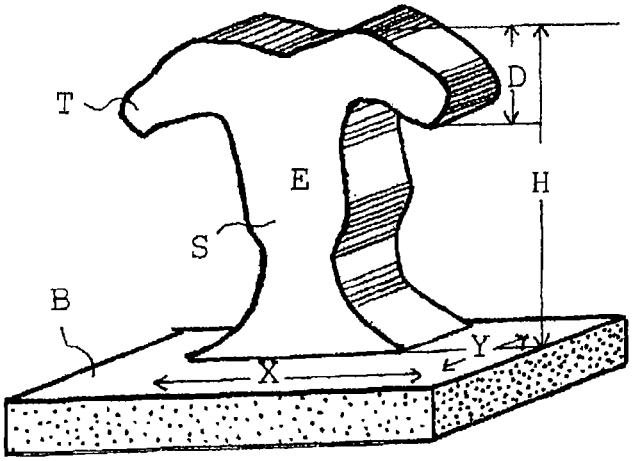
FIG. 5 shows the perspective view of an example fastening element forming a conventional molded male surface fastener.

Importantly, in the present invention, the ratio (D/H) of the length (D) from the uppermost tip of the fastening element (E) to the lower end of the engaging projection (T) to the height (H) of the fastening element is 0.35-0.75, which is extremely high compared conventional one, as described above. A conventionally and generally known molded surface fastener has male fastening elements each with a shape as shown in FIG. 5, in which the ratio (D/H) of the length from the uppermost tip of each of fastening elements to the lower end of the engaging projection of the fastening element falls within the range of about 0.15-0.25. In light of this, it can be said that the shape of the fastening element of the molded surface fastener according to the present invention is extremely specific.

In the molded surface fastener with extremely low fastening elements, if the value of the ratio (D/H) is reduced, the engaging projection becomes thinner inevitably so as to be bent easily, resulting in not providing a required engagement force. For this reason, there exists the molded surface fastener with a ration (D/H) falling within the range as specified in the present application invention. However, the range of about 0.20-0.30 is adopted for a fastening element with a height (H) of more than 1.2 mm.

Regarding this ratio (D/H), the fastening element shown in FIG. 2 of Patent document 3 has a ratio (D/H) of 0.7 which is calculated from this figure. However, Patent document 3 does not describe anything about the plate coverage as specified by the present invention. If this fastening element has the plate coverage of a conventionally general molding fastener, the plate coverage is 15-22% as described below. Therefore, the invention of Patent document 3 cannot achieve the effect of the present invention on obtaining a strong engagement force after permanent engagement without causing a strong engagement in temporary fixing (i.e. positioning).

In the molded hook fastener of Patent document 4, the ratios (D/H) are determined respectively from the armed loops (corresponding to D) described in Table 1 according to the examples described in this document and the hook height (corresponding to H) is 0.38 for the comparative example 1, 0.52 for the example 1, 0.56 for the example 2, and 0.40 for the example 6. Some of these ratios satisfy the range of the ratio (D/H) specified in the present invention. However, regarding the plate coverage, which is another major requirement of the present invention, the plate coverages are determined from the hook width, the hook thickness, the number and the row of hooks in Table 1 described in Patent Document 4. Among these, the largest plate coverage is 14.6% for the comparative example 1. This plate coverage does not satisfy the range of the plate coverage specified as 25-45% in the present invention. Therefore, the invention of Patent document 4 cannot achieve the effect of the present invention on obtaining a strong engagement force after permanent engagement without causing a strong engagement in temporary fixing (i.e. positioning).

FIG. 2 shows the perspective view of a preferred example fastening element forming the molded male surface fastener of the present invention. In the fastening element of this figure, an anti-sticking projection (M) is provided at the top of the fastening element in order to increase the value of the ratio (D/H). The anti-sticking projection does not need to be provided on the top of the fastening element and may project from the engaging projection (T) away from the plate. The number of anti-sticking projections does not need to be one per one fastening element and may be two or more.

Furthermore, the anti-sticking projection does not need to be vertical to the surface of the plate surface, but only have to project away from the plate. One or more anti-sticking projections preferably exist on each of the fastening elements. However, one anti-sticking projection may exist per 2-3 fastening elements neighboring in the direction of the engaging projections of the fastening elements.

Figure 3:
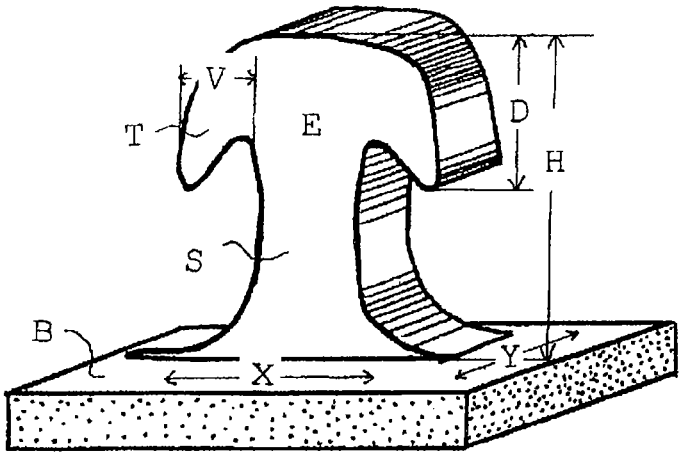
FIG. 3 shows the perspective view of another preferred example fastening element forming the molded male surface fastener of the present invention.

FIG. 3 shows the perspective view of another preferred example fastening element forming the molded male surface fastener of the present invention. In the fastening element of this figure, the anti-sticking projection is not provided, but the head of the fastening element is made much larger, in order to increase the value of the ratio (D/H). Compared with the shape of the conventionally general fastening element of FIG. 5, it can be understand that the head of the fastening element of FIG. 3 is made much larger.

As the height of the anti-sticking projection or the thickness of the head of the fastening element, the above-mentioned ratio (D/H) falls within the range of 0.35-0.75. In other words, to set the ratio (D/H) to fall within the range of 0.35-0.75, the anti-sticking projection just has to be provided on the head, or the head only has to be made larger. If the ratio (D/H) is less than 0.35, an engagement easily occurs in positioning, not producing the effect of the present invention. If the ratio (D/H) is more than 0.75, a strong engagement is not achieved even after permanent engagement, not providing an expected engagement force. The ratio (D/H) preferably falls within the range of 0.40-0.70, more preferably 0.45-0.65.

If the anti-sticking projection with a sharp tip is provided, the texture of the surface fastener worsens. For this reason, the anti-sticking projection preferably exists with a round shaped head as shown in FIGS. 1 and 2. The anti-sticking projection is made of the same resin as those of the stem and the head.

Figure 4:
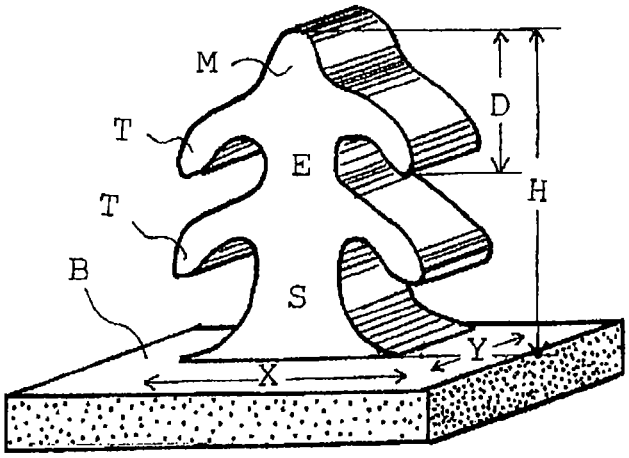
FIG. 4 shows the perspective view of yet another preferred example fastening element forming the molded male surface fastener of the present invention.

The male fastening element shown in FIG. 4 is one suitable example of the present invention. In this fastening element, two engaging projections project each of both sideways from the stem. In this manner, when a plurality of engaging projections exist in the vertical direction, the length (D) from the uppermost tip of the fastening element (E) to the lower end of the engaging projection (T) is intended for the engaging projection existing at the top.

As a major aspect in the present invention, not only the ratio (D/H) of the length from the uppermost tip of the fastening element (E) to the lower end of the engaging projection (T) to the height (H) of the stem, as described above, but also the plate coverage of fastening elements are pointed out. It is extremely important in the present invention that the plate coverage fall within the range of 25-45%. Considering that the plate coverage of fastening elements is 15-22% in a conventionally and generally known molded male surface fastener, it can be said that the value specified in the present invention is extremely high. If the plate coverage of fastening elements is less than 25%, an engagement is generated in positioning so that the objective of the present invention cannot be achieved. On the other hand, if the plate coverage is more than 45%, a strong engagement is not achieved even after permanent engagement, not providing an expected engagement force. The plate coverage of fastening elements preferably falls within the range of 27-42%, more preferably 28-40%.

In the present invention, the ratio (D/H) and the plate coverage of fastening elements need to fall within the ranges specified in the present invention, respectively, to achieve the objective of the present invention. If any one of the ratio (D/H) and the plate coverage does not fall within the corresponding range specified in the present invention, the objective of the present invention cannot be achieved.

The plate coverage of fastening elements of the present invention is the proportion of the top surface of the heads of the male fastening elements to the area of the plate from which the male fastening elements project upword. Specifically, the photograph of the part on which male fastening elements exist continuously is taken from above with an optical microscope, any part of the plate in this photograph, on which 50 male fastening elements exist, is marked off, the area of the marked-off part (s1) and the total top surfaces of the heads of 50 male fastening elements existing on the marked-off part (s2) are determined, and then the plate coverage (%) of the fastening element is calculated from the formula:

$$[(s2)/(s1)]\times 100.$$

Figure 6:
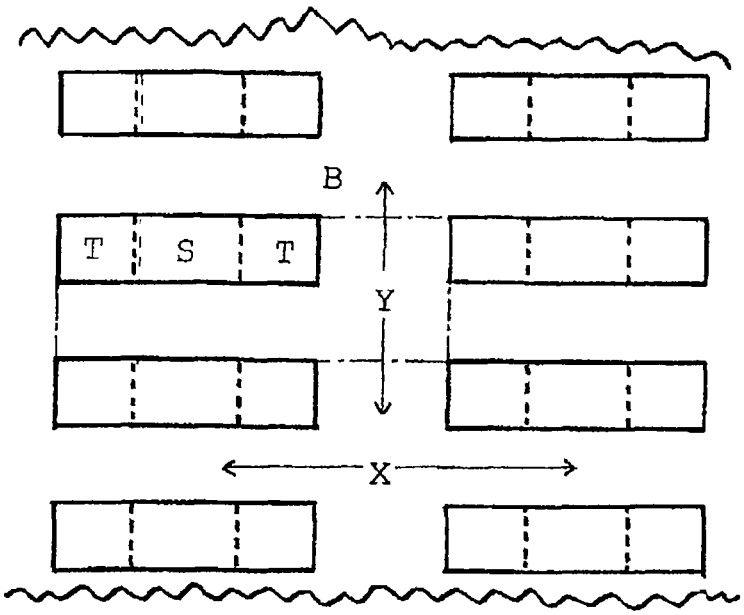
FIG. 6 shows the top view of an example of the molded male surface fastener of the present invention, illustrating the plate coverage of fastening elements, which is specified in the present invention.
Figure 7:
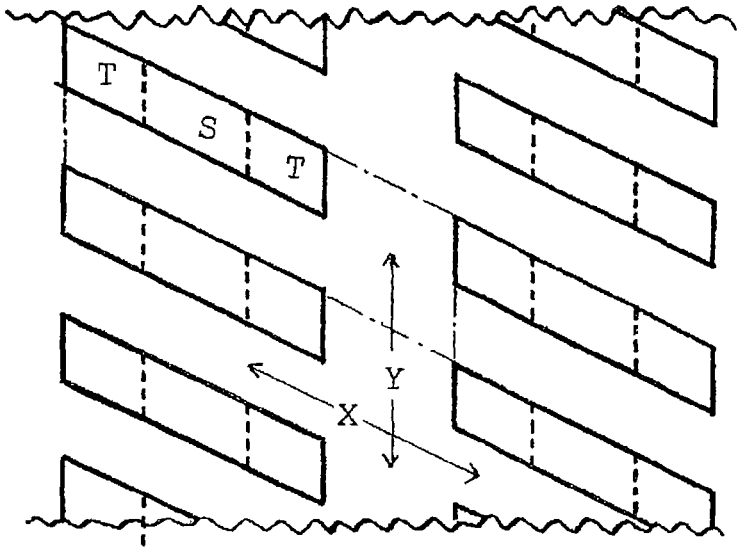
FIG. 7 shows the top view of another example of the molded male surface fastener of the present invention, illustrating the plate coverage of fastening elements, which is specified in the present invention.

FIGS. 6 and 7 are the pattern diagrams of the part on which fastening elements exist continuously, which are taken from above with an optical microscope. In these figures, S represents a stem, T represents an engaging projection, and B represents a plate. The directions X and Y in these figures correspond to the directions X and Y in FIGS. 1-4, respectively. As shown in FIGS. 6 and 7, when the fastening elements project upword from the plate with regularity, a quadrate with the side between the end of one fastening element and one neighboring fastening element and the side between this end of the fastening element to another neighboring fastening element is drawn (as represented by alternate long and short dash lines in FIGS. 6 and 7), and then the proportion of the area of one fastening element seen from above (S+2T) to the area of the quadrate is determined to calculate the plate coverage of fastening elements. In FIGS. 6 and 7, the plate coverage of fastening elements is 30.3%.

In the present invention, the interval between the engaging projections of one male fastening element and one neighboring male fastening element next to this male fastening element in the projecting direction (i.e. the direction X shown in the figures) appropriately falls within the range of 0.6-2.5 mm. If the interval is less than 0.6 mm, sufficient engagement force is not obtained. If the interval is more than 2.5 mm, the above-mentioned plate coverage of fastening elements is hardly achieved.

In the present invention, the height (H) of the fastening element is preferably 1.2-3.0 mm. If the height is less than 1.2 mm, sufficient engagement force is not obtained, which is unpreferable. If the height is more than 3.0 mm, the hook is easily fallen and then easily hooked into a loop-shaped fastening element by a small force, which is also unpreferable. The height more preferably falls within the range of 1.5-2.7 mm, further more preferably 1.6-2.6 mm.

In the present invention, the engaging projection preferably projects from the stem by 0.2-0.8 mm. Specifically, V is preferably 0.2-0.8 mm in the fastening element shown in FIG. 2. If V is less than 0.2 mm, sufficient engagement force is not obtained. If V is more than 0.8 mm, the engagement is stronger, causing the element and the loop to be damaged in the release. V is more preferably 0.3-0.6 mm. The engaging projection is typically made of the same resin as that of the stem.

In the present invention, the thickness of each of the male fastening elements (W shown in FIG. 2.), preferably falls into the range of 0.15-0.6 times the height (H) of the fastening element. If the thickness is less than 0.15 times the height, the strength of the fastening element is decreased not so as to provide sufficient engagement force. If the thickness is more than 0.6 times the height, the male fastening element is hardly engaged with a loop-shaped fastening element not so as to provide sufficient engagement force. The thickness preferably falls within the range of 0.18-0.5 times the height. For the same reason of the above-mentioned fastening element thickness (W), the stem of the fastening element preferably have a sectional area parallel to the plate that falls within the range of 0.09-0.4 $mm^2$.

In the present invention, the thickness of the plate (B) is not limited in particular, but appropriately falls within the range of 0.15-0.8 mm. The density of fastening elements preferably falls within the range of 20-50 elements/$cm^2$, more preferably 30-40 elements/$cm^2$ in particular.

The method of producing the molded male surface fastener of the present invention will be explained in detail below.

Figure 8:
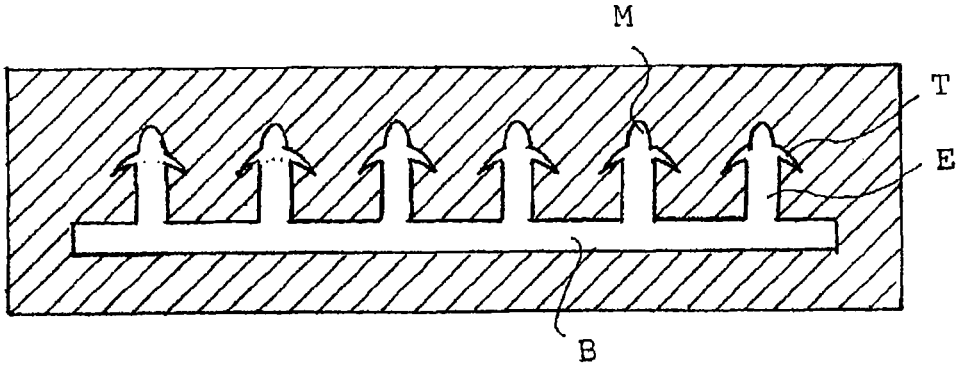
FIG. 8 shows the front view of a preferred example extrusion nozzle used for manufacturing the molded male surface fastener of the present invention.

First, a thermoplastic resin is melt-extruded from a nozzle as shown in FIG. 8, which has slits each with a shape corresponding to the male fastening element E provided with an anti-sticking projection M and an engaging projection T and the surface fastener plate B as shown in FIG. 1, and then cooled so as to mold a tape with a plurality of lines which project upword from the plate, each of which has the cross section of a mushroom-shaped fastening elements continuing in the length direction. B shown in FIG. 8 is a line slit to form the plate, and E is a slit for a fastening element to form the male fastening element. When slits as shown in FIG. 8 are used, a tape provided with six lines for male fastening elements which project upword from the surface of the plate and each having an anti-sticking projection existing at equal intervals is obtained. The number of the lines is preferably 5-15 per a tape width of 1 cm after drawing. The tape width is preferably 20-50 mm.

Next, cuts are made in the lines for fastening elements existing on the surface of the obtained tape from the tips to near the roots of the lines at small intervals in a direction of traversing, preferably a direction perpendicular to the length direction (Y) of the tape. The intervals fall within the range of 0.2-0.6 mm, appropriately 0.3-0.5 mm in particular. Next, the tape is drawn in the length direction. The draw ratio is employed so that the length of the tape after drawing can be about 1.3-3.5 times the original length. This drawing widens cuts made in the lines, making the lines become the rows each having a number of independent male fastening elements. FIG. 6 shows the case in which cuts are made in a direction perpendicular to the line of length direction, and FIG. 7 shows the case in which cuts are made in an oblique direction. In the present invention, cuts may be made in a direction perpendicular or a direction oblique to the length direction of the line.

As specified in the present invention, in order to increase the ratio (D/H) of the length (D) from the tip of a fastening element to the lower end of the fastening element to the height (H) of the fastening element from the plate, the head of the slit for a fastening element (E) shown in FIG. 8 only has to be made larger, or only has to provide a notch (M) corresponding to the anti-sticking projection on a stem as shown in FIG. 8. In the present invention, the plate coverage of fastening elements needs to be high as described above. The plate coverage of fastening elements can be increased by significantly projecting both wings of the part T of the head of each slit for a fastening element of the nozzle shown in FIG. 8, by narrowing the intervals of the slits for neighboring fastening elements, or by lowering the draw ratio.

The above-mentioned explanation is provided for a method of producing the molded male surface fastener of the present invention, including extruding a resin from slits, making cuts in the obtained lines for fastening elements, and drawing the lines with cuts. The method of producing the molded male surface fastener of the present invention is not limited to this production method. For example, the molded male surface fastener can be produced by a method including pouring melted resin liquid on the metal surface provided with a number of holes for stems and then the holes for stems, forming a resin solution layer on the metal surface; cooling the poured resin; removing the resin sheet from the metal surface to produce a resin board with a large number of stems projecting upword from the surface of the plate resin sheet; attaching only the tips of the stems to a hot metal plate with recesses for anti-sticking projections to melt the tips; and molding the tips to obtain mushroom-shaped stems, the mushroom tips of which are to be anti-sticking projections, or the mushroom caps of which are made larger; and the like.

As just described, the present invention relates to a male molded surface fastener by improving a conventional surface fastener, particularly a molded male surface fastener, the only overlaying of which causes an engagement to make the positioning extremely difficult and to provide a molded male surface fastener obtaining a strong engagement force after permanent engagement without causing a strong engagement in positioning. In order to more strongly exert such an effect, a female surface fastener used in a pair with such a molded male surface fastener is preferably elaborated and improved.

As the female surface fastener, (1) a female surface fastener having loops formed from multi-filament yarn on the surface of the plate, in which the multi-filament yarn forming the loop is fixed up with a resin or (2) a female surface fastener including loops formed from mono-filament yarn on the surface of the plate is used to strongly exert the above-mentioned effect of the present invention.

As such a female surface fastener, a so-called knitted woven fastener with a knitted woven fabric plate is used. While the male surface fastener is a molded surface fastener, the female surface fastener used in a pair with the male surface fastener is preferably a knitted woven fastener.

Typically, in a knitted woven fastener with loop-shaped fastening elements as female materials, multi-filament yarn to form loop-shaped fastening elements is woven or knitted to the base fabric that is a woven or knitted plate. In the multi-filament yarn to be used, 5-15 filaments of 10-50 decitex are preferably bundled from the viewpoint of easier positioning as well as strong engagement force after permanent engagement. In the case of a loop-shaped fastening element formed from multi-filament yarn, most of the filaments may be fixed up to form a bundle (loop), and the remaining filaments may be used independently or in a bundle of two or three to form another loop projecting from the fastening element. Such a loop projecting from a typical loop may cause an engagement only by being overlaid on a molded male surface fastener in positioning.

As the result of the study how to prevent a filament from being separated from a bundle of multi-filament yarn forming a loop from the viewpoint of easier positioning, it is found that a female surface fastener as the above-mentioned (1) or (2) is used to achieve this prevention.

In the above-mentioned female surface fastener (1), multi-filament yarn forming a loop is fixed up with a resin, or a resin is applied to multi-filament yarn after a loop is formed, so as to prevent a filament from being separated from multi-filament yarn, or the like.

The resin to be used preferably has adhesiveness to multi-filament yarn, including, for example, an elastomer resin, typically polyurethane, a vinyl acetate resin, a nylon resin, an acrylic resin, and a rubber resin as the representative examples. The resin is applied to the multi-filament yarn or the loop-shaped fastening elements in the state of a solution or an emulsion. The application amount of resin is appropriately 5-15 weight % to multi-filament yarn. After the application, an individual filament forming multi-filament yarn is restrained by drying, hardly leading to the problem in which a filament forming multi-filaments is separated from multi-filaments and projected from a loop to form another loop.

As the yarn forming a loop-shaped element, mono-filament yarn may be used in place of conventionally and generally used multi-filament yarn. The mono-filament yarn to be used preferably has a diameter of 0.04-0.12 mm.

The resin forming multi-filament yarn or mono-filament yarn includes a resin drawable and capable of fiber formation, which is selected from the resins described above as a resin used for the plate (B) and the male fastening element (E). Specifically, the resin forming mono-filament yarn includes typical synthetic fiber resins, for example, polyolefin resins such as polyethylene and polypropylene; nylon resin such as nylon 6 and nylon 66; polyester resins such as polyethylene terephthalate, polybutylene terephthalate, and polylactic acid.

As a method of producing such a loop-shaped female surface fastener, a conventionally general method of producing a knitted woven surface fastener is used. The density of loop-shaped fastening elements of such a loop-shaped female surface fastener is typically 30-150 elements/$cm^2$. The height of a loop element from the base fabric of the surface fastener is preferably 1-2 mm.

Only if used in combination with the molded male surface fastener of the present invention, a conventionally general female surface fastener (specifically, a female fastener in which multi-filament yarn forming loop-shaped fastening elements is not fixed up with a resin or the like) provides easier positioning and a far stronger engagement force after permanent engagement, compared with that used in combination with a conventionally and generally used male surface fastener. For this reason, a conventionally and generally used loop-shaped female surface fastener is used with the molded male surface fastener of the present invention. As a preferable combination with the molded male surface fastener of the present invention, a loop-shaped female surface fastener with loops formed from multi-filaments fixed up a resin as described above or mono-filaments used for loop elements from the viewpoint of easy positioning.

According to the present invention, a strong engagement is not caused in temporary fixing (i.e. positioning) but obtained after permanent engagement. As a result, the positioning when the surface fastener is attached is easier. Furthermore, after permanent engagement, an engagement being in no way inferior to that from a conventional molded male surface fastener is obtained. Specifically, using the combination of the molded male surface fastener and the female surface fastener of the present invention highly achieves the above-mentioned effect.

Specifically, in the production line running at a constant rate for manufacturing automobiles, once the fastening position is inaccurate when a ceiling material is fastened to the ceiling base material of an automobile or when a surface material for a luggage room is fastened to the luggage room of an automobile, the engagement needs to be released, and then the fastening needs to be repeated. This disrupts the production line, or a handling such as reducing the rate of the production line is required. However, using the molded surface fastener of the present invention makes the positioning easier so that the occurrence of mispositioning can be decreased.

In the interior finisher work for a house or the like, using the molded male surface fastener of the present invention for a ceiling material and a wall material can prevent mispositioning. This can reduce the work time and can also prevent the ceiling material and the wall material from being damaged when these misaligned materials are detached. Particularly, when the size of an intended object to be attached is large, the molded male surface fastener of the present invention has extremely large effect.

The molded male surface fastener of the present invention is extremely excellent as a fastening means for fastening an intended object to a large area at a predetermining position. For example, an intended object to be attached, which is a sheet or a plate with an area of 0.1 $m^2$ or more, particularly 0.2 $m^2$ produces an outstanding effect.

The molded male surface fastener of the present invention is attached to the back surface of an intended object or the surface of a base material with an adhesive or glue, by fusing, sewing, or stapling. On the other hand, a female woven surface fastener is attached to the back surface of an intended object or the surface of a base material with an adhesive or glue, or by fusing, sewing, or stapling.

EXAMPLES

The present invention will be explained with reference to the examples described below.

In the examples, the engagement force were measured based on the method described in JIS L3416.

The inventors observed the pressing force typically generated in positioning and then found that this pressing force is about 100 g/cm. From this fact, the engagement force generated when the engagement surface of a male surface fastener and the engagement surface of a female surface fastener are pressed on each other at a pressing force of 100 g/cm is defined as the engagement force in positioning. The engagement force generated when the engagement surface of a male surface fastener and the engagement surface of a female surface fastener are pressed on each other at a pressing force of 500 g/cm is defined as the engagement force in permanent engagement.

As the female surface fastener, an female surface fastener (B2790Y: loop yarn formed from polyester multi-filaments of 265 decitex/7 filaments) available KURARAY FASTENING CO., LTD., in which a polyurethane resin was applied to the loop elements in 10 weight % based on the multi-filaments to fix up the loop elements, and the loop elements had a density of loop elements 40 elements/$cm^2$, was used unless stated.

Example 1

A polyester resin was extruded from a nozzle as shown in FIG. 8 and then cooled so as to mold a tape with a plurality of lines and with the cross section of mushroom-shaped fastening elements continuing in the length direction. The number of the lines was 10, and the width of the tape was 35 mm. Then, cuts are made in the lines from the tip to near the root of the lines at 0.5 mm intervals in a direction perpendicular to the length direction of the tape. Next, the tape is drawn 2.2 times in the length direction. Each of the obtained male fastening elements has an anti-sticking projection (M) on the head as shown in FIGS. 1 and 2.

The height (H) of each of the fastening elements of the obtained molded male surface fastener was 2.5 mm; the length (D) from the uppermost tip of each fastening element to the lower end of the engaging projection was 1.3 mm; the interval between the engaging projections of one male fastening element and one male fastening element next to this male fastening element in the projecting direction (i.e. in the direction X shown in FIG. 2) was 1.0 mm; the projection length (V) of each engaging projection was 0.6 mm; the thickness of each male fastening element (W shown in FIG. 2) was 0.5 mm; the thickness of the stem of each fastening element was 0.3 $mm^2$; the thickness of the plate (B) was 0.2 mm; and the density of fastening elements was 31 elements/$cm^2$.

The obtained molded male surface fastener is applied on a plastic board. On the other hand, as the female surface fastener to engage this molded male surface fastener (female surface fastener (B2790Y), available from KURARAY FASTENING CO., LTD.), in which the loop elements of the above-mentioned loop surface fastener are fixed up with a polyurethane resin, was used. Next, two surface fasteners were overlaid on each other, and then the peel strengths at a pressing force of 100 g/cm and at a pressing force of 500 g/cm were measured, respectively. As a result, the engagement was not caused at a pressing force of 100 g/cm, but a peel strength of 600 g/cm was obtained at 500 g/cm. It was confirmed that this molded male surface fastener does not generate an engagement in positioning but a strong engagement by typical pressing after permanent engagement.

This molded male surface fastener was attached to the back surface of an interior member for the ceiling of an automobile with an adhesive. On the other hand, a female woven surface fastener was attached to the iron plate of the ceiling of the car body with an adhesive. Then, both the fasteners were overlaid on each other for positioning. As a result, an engagement was not caused so that the positioning can be easily conducted. Next, the most suitable position was determined, and then the interior member for a ceiling was pressed to the iron plate of the ceiling. As a result, both the members were fastened by a sufficient engagement force.

Example 2

Except that the draw ratio is set to 1.5 times, the molded male surface fastener was produced by the same method as that of Example 1. The height (H) of each fastening element of the obtained molded male surface fastener was 2.5 mm; the length (D) from the uppermost tip of each fastening element to the lower end of the engaging projection was 1.3 mm; the interval between the engaging projections of one male fastening element and one neighboring male fastening element next to this male fastening element in the projecting direction (i.e. the direction X shown in FIGS. 1 and 2) was 1.8 mm; the projection length (V) of each engaging projection was 0.6 mm; the thickness of each male fastening element (W shown in FIG. 2) was 0.5 mm; the thickness of the stem of each fastening element was 0.3 $mm^2$; the thickness of the plate (B) was 0.25 mm; and the density of fastening elements was 40 elements/$cm^2$.

In the same way as Example 1, the obtained molded male surface fastener was engaged with the same female woven surface fastener as that of Example 1. Next, the engagement forces (peel strengths) at a pressing force of 100 g/cm and at a pressing force of 500 g/cm were measured, respectively. The result is shown in Table 1. In Example 2 as well as Example 1, it was confirmed that an engagement is not caused in positioning but a strong engagement is generated by typical pressing after permanent engagement.

Comparative Example 1

Except that the draw ratio is set to 1.2 times, the molded male surface fastener was produced by the same method as that of Example 1. The height (H) of each fastening element of the obtained molded male surface fastener was 2.5 mm; the length (D) from the uppermost tip of each fastening element to the lower end of the engaging projection was 1.3 mm; the interval between the engaging projections of one male fastening element and one neighboring male fastening element next to this male fastening element in the projecting direction (i.e. the direction X shown in FIGS. 1 and 2) was 2.0 mm; the projection length (V) of each engaging projection was 0.6 mm; the thickness of each male fastening element (W shown in FIG. 2) was 0.5 mm; the thickness of the stem of each fastening element was 0.3 $mm^2$; the thickness of the plate (B) was 0.3 mm; and the density of fastening elements was 45 elements/$cm^2$.

In the same way as Example 1, the obtained molded male surface fastener was engaged with the same female woven surface fastener as that of Example 1. Next, the engagement forces (peel strengths) at a pressing force of 100 g/cm and at a pressing force of 500 g/cm were measured, respectively. The result is shown in Table 1.

It was confirmed that a strong engagement is not caused not only in positioning but also a strong engagement by typical pressing after permanent engagement.

Comparative Example 2

Except that the draw ratio is set to 3.3 times, the molded male surface fastener was produced by the same method as that of Example 1. The height (H) of each fastening element of the obtained molded male surface fastener was 2.5 mm; the length (D) from the uppermost tip of each fastening element to the lower end of the engaging projection was 1.3 mm; the interval between the engaging projections of one male fastening element and one neighboring male fastening element next to this male fastening element in the projecting direction (i.e. the direction X shown in FIGS. 1 and 2) was 0.8 mm; the projection length (V) of each engaging projection was 0.6 mm; the thickness of each male fastening element (W shown in FIG. 2) was 0.5 mm; the thickness of the stem of each fastening element was 0.3 $mm^2$; the thickness of the plate (B) was 0.15 mm; and the density of fastening elements was 20 elements/$cm^2$.

In the same way as Example 1, the obtained molded male surface fastener was engaged with the same female woven surface fastener as that of Example 1. Next, the engagement forces (peel strengths) at a pressing force of 100 g/cm and at a pressing force of 500 g/cm were measured, respectively. The result is shown in Table 1. It was confirmed that this molded male surface fastener generates a strong engagement even in positioning.

TABLE 1

| | | Example 1 | Example 2 | Comparative Example 1 | Comparative Example 2 |
|---|---|---|---|---|---|
| Draw ratio | | 2.2 | 1.5 | 1.2 | 3.3 |
| D/H | | 0.52 | 0.52 | 0.52 | 0.52 |
| Plate coverage of fastening elements (%) | | 30 | 40 | 48 | 20 |
| Peel strength (g/cm) | Pressing force of 100 g/cm | Not engaged | Not engaged | Not engaged | 300 |
| | Pressing force of 500 g/cm | 600 | 450 | 20 | 650 |

Examples 3-4 and Comparative Examples 3-4

Except that nozzles each with the height of the part corresponding to M of FIG. 8 being variously changed were used, the molded male surface fastener was produced by the same method as that of Example 1. In the same way as Example 1, a female woven surface fastener with loop elements being restrained with a resin was used to measure the engagement forces (peel strengths) at a pressing force of 100 g/cm and at a pressing force of 500 g/cm, respectively. The result is shown in Table 2. In any of Examples 3-4, it was confirmed that an engagement is hardly caused in positioning but that a sufficient engagement is generate by the pressing force generating a typical engagement.

In Comparative Examples 3-4, the molded male surface fastener was produced by the same method as that described Example 1 except that a nozzle to be a hook with a typical shape and without the part corresponding to M of FIG. 8, as shown in FIG. 5 was used. In Comparative Examples 3-4, a female woven surface fastener with loop elements being restrained with a resin was used to measure the engagement forces (peel strengths) at a pressing force of 100 g/cm and at a pressing force of 500 g/cm, respectively, in the same way as Example 1. The result is shown in Table 2.

In Comparative Example 3, an engagement was not generated in positioning, or a sufficient engagement force was not obtained even after permanent engagement. In Comparative Example 4, a strong engagement was generated even in positioning, causing difficulty in accurate positioning.

TABLE 2

| | | Example 3 | Example 4 | Comparative Example 2 | Comparative Example 4 |
|---|---|---|---|---|---|
| D/H | | 0.61 | 0.41 | 0.80 | 0.25 |
| Plate coverage of fastening elements (%) | | 31 | 35 | 35 | 35 |
| Peel strength (g/cm) | Pressing force of 100 g/cm | Not engaged | Not engaged | Not engaged | 200 |
| | Pressing force of 500 g/cm | 650 | 450 | 30 | 300 |

Example 5

Except that the part corresponding to M was removed, that the part corresponding to the head was made larger, and that a nozzle in which a ratio D/H of each fastening element of the obtained molded male surface fastener is 0.37 is used, the molded male surface fastener was produced in the same way as Example 1. This obtained molded male surface fastener was used to engage with the female woven surface fastener to measure the engagement force in the same way as Example 1. As a result, the engagement was not caused at a pressing force of 100 g/cm, but a peel strength of 620 g/cm was obtained at 500 g/cm. The result is shown in Table 3. It was confirmed that this molded male surface fastener does not generate an engagement in positioning but a strong engagement by typical pressing after permanent engagement.

Example 6

Except that a female woven surface fastener with loop elements formed from polyester mono-filaments of 197 decitex and with a density of loop elements of 120 elements/$cm^2$ was used, these fasteners were engaged with each other in the same way of Example 1. As a result, the engagement was not caused at a pressing force of 100 g/cm, but a peel strength of 400 g/cm was obtained at 500 g/cm. The result is shown in Table 3. It was confirmed that this molded male surface fastener does not generate an engagement in positioning but a strong engagement by typical pressing after permanent engagement.

Example 7

Except that the molded male surface fastener obtained in Example 5 was used and that a loop surface fastener (female surface fastener (Part number: NEW ECO MAGIC B-2790Y), available from KURARAY FASTENING CO., LTD) with loop elements formed from multi-filament yarn in which 7 filaments of 38 decitex are bundled was used as a female surface fastener to be engaged, these surface fasteners were engaged with each other in the same way of Example 1. Next, two surface fasteners were overlaid on each other, and then the peel strengths at a pressing force of 100 g/cm and at a pressing force of 500 g/cm were measured, respectively. As a result, the engagement was not caused at a pressing force of 100 g/cm, but a peel strength of 320 g/cm was obtained at 500 g/cm. The result is shown in Table 3. It was confirmed that this molded male surface fastener does not generate an engagement in positioning but a strong engagement by typical pressing after permanent engagement.

This molded male surface fastener was attached to the back surface of an interior member for the ceiling of an automobile with an adhesive. On the other hand, the female woven surface fastener was attached to the iron plate of the ceiling of the car body with an adhesive. Then, both the fasteners were overlaid on each other for positioning. As a result, an engagement was not caused so that the positioning can be easily conducted. Next, the most suitable positioning was determined, and then the interior member for a ceiling was pressed to the iron plate of the ceiling. As a result, both the members were fastened by a sufficient engagement force.

Example 8

In the same way as Example 1, as the female woven surface fastener to be engaged, an female surface fastener available KURARAY FASTENING CO., LTD. (B2790Y: loop yarn formed from polyester multi-filaments of 265 decitex/7 filaments) in which the loop elements are formed from multi-filament yarn in which multi-filaments are not bundled with a resin, was used and then engaged with the molded male surface fastener of Example 1. As a result, a peel strength of 20 g/cm was obtained at pressing force of 100 g/cm, and a peel strength of 700 g/cm was obtained at 500 g/cm. The result is shown in Table 3.

It was confirmed that this molded male surface fastener generates an engagement in positioning, which is not really a problem, and a strong engagement by typical pressing after permanent engagement.

TABLE 3

| | | Example 5 | Example 6 | Example 7 | Example 8 |
|---|---|---|---|---|---|
| D/H | | 0.37 | 0.52 | 0.37 | 0.52 |
| Plate coverage of fastening elements (%) | | 30 | 30 | 30 | 30 |
| Peel strength (g/cm) | Pressing force of 100 g/cm | Not engaged | Not engaged | Not engaged | 20 |
| | Pressing force of 500 g/cm | 620 | 400 | 320 | 700 |

INDUSTRIAL APPLICABILITY

The molded male surface fastener or the combination of this surface fastener and a female woven surface fastener of the present invention does not generate a strong engagement in temporary fixing (positioning) but after permanent engagement. Therefore, the molded male surface fastener or the combination can be suitably applied for the field in which a conventional molded male surface fastener is used, for example, the field of fastening a wall material, a floor material, a ceiling material, and the like.

The method of fastening an intended object to the base material of the present invention can suitably to be used, specifically to fasten a ceiling material that is an interior member to the ceiling base material of an automobile, or to fasten a molding member for formation to a luggage room.

Furthermore, according to the method of fastening an intended object to the base material of the present invention, in the interior finisher work for a houses or the like, using the molded male surface fastener of the present invention for a ceiling material and a wall material can prevent mispositioning. This can reduce the work time and can also prevent the ceiling material and the wall material from being damaged when these misaligned materials are detached. Therefore, when the size of an intended object to be attached is large, this method can be used as the useful fastening method.

The invention claimed is:

1. A molded surface fastener, comprising:

a large number of male fastening elements projecting upward from a surface of a plastic plate, wherein each of the male fastening elements has a stem projecting upward from the surface of the plastic plate and an engaging projection projecting sideways from the stem, wherein a height (H) of each of the male fastening elements is from 1.5-3.0 mm, wherein a ratio (D/H) of a length (D) from an uppermost tip of each of the male fastening elements to a lower end of the engaging projection of each of the male fastening elements to the height (H) of each of the male fastening elements from the surface of the plate is 0.45-0.75, such that the length (D) of each of the male fastening elements is from 0.675-2.25 mm, wherein a plate coverage of male fastening elements is 25-45%, and wherein each of the male fastening elements has an anti-sticking projection projecting away from the surface of the plate above the engaging projection.

2. The molded surface fastener according to claim 1, wherein the ratio (D/H) is 0.45-0.65, such that the length (D) of each of the male fastening elements is from 0.675-1.95 mm.

3. The molded surface fastener according to claim 1, wherein a thickness (W) of each of the male fastening elements is 0.15-0.6 times the height (H) of each of the male fastening elements.

4. A female surface fastener used in a pair with the molded surface fastener according to claim 1, the female surface fastener comprising a plate comprising a loop formed from multi-filament yarn on a surface thereof.

5. A female surface fastener used in a pair with the molded surface fastener according to claim 1, the female surface fastener comprising a plate comprising a loop formed from multi-filament yarn on a surface thereof, wherein filaments of the multi-filament yarn forming the loop are adhered together with a resin.

6. A female surface fastener used in a pair with the molded surface fastener according to claim 1, the female surface fastener comprising a plate comprising a loop formed from mono-filament yarn on a surface thereof.

7. A method of fastening a ceiling material to a ceiling base material, the method comprising:

fixing the molded surface fastener according to claim 2 to any one of the ceiling material and the ceiling base material;

attaching a surface fastener engageable with the molded surface fastener to the other one of the ceiling material and the ceiling base material; and engaging the molded surface fastener with the surface fastener engageable with the molded surface fastener.

8. A method of fastening a decorative board to a wall base material, the method comprising:

fixing the molded surface fastener according to claim 2 to any one of the decorative board and the wall base material;

attaching a surface fastener engageable with the molded surface fastener to the other one of the decorative board and the wall base material; and engaging the molded surface fastener with the surface fastener engageable with the molded surface fastener.

9. The molded surface fastener according to claim 1, wherein the height (H) of each of the male fastening elements is from 1.5-2.7 mm, such that the length (D) of each of the male fastening elements is from 0.675-2.025 mm.

10. The molded surface fastener according to claim 1, wherein the height (H) of each of the male fastening elements is from 1.6-2.6 mm, such that the length (D) of each of the male fastening elements is from 0.72-1.95 mm.

11. The molded surface fastener according to claim 1, wherein the ratio (D/H) is 0.52-0.75, such that the length (D) of each of the male fastening elements is from 0.78-2.25 mm.

* * * * *